US008424377B2

(12) United States Patent
Keller

(10) Patent No.: US 8,424,377 B2
(45) Date of Patent: Apr. 23, 2013

(54) MONITORING THE WATER TABLES IN MULTI-LEVEL GROUND WATER SAMPLING SYSTEMS

(76) Inventor: Carl E. Keller, Santa Fe, NM (US)

( * ) Notice: Subject to any disclaimer, the term of this patent is extended or adjusted under 35 U.S.C. 154(b) by 493 days.

(21) Appl. No.: 12/802,881

(22) Filed: Jun. 16, 2010

(65) Prior Publication Data

US 2010/0319448 A1 Dec. 23, 2010

Related U.S. Application Data

(60) Provisional application No. 61/268,870, filed on Jun. 17, 2009.

(51) Int. Cl.
*E21B 49/08* (2006.01)

(52) U.S. Cl.
USPC ..... 73/152.28

(58) Field of Classification Search ..... 73/152.28, 73/290 R, 298, 299, 323; 166/264
See application file for complete search history.

(56) References Cited

U.S. PATENT DOCUMENTS 4,778,553 A 10/1988 Wood
5,176,207 A 1/1993 Keller
5,246,862 A 9/1993 Grey et al.
5,377,754 A 1/1995 Keller
5,725,055 A * 3/1998 Schirmer et al. ..... 166/264
5,803,666 A 9/1998 Keller
5,804,743 A 9/1998 Vroblesky et al.
5,853,049 A 12/1998 Keller
6,026,900 A 2/2000 Keller
6,109,828 A 8/2000 Keller
6,244,846 B1 6/2001 Keller
6,283,209 B1 9/2001 Keller
6,298,920 B1 10/2001 Keller
6,910,374 B2 6/2005 Keller
7,281,422 B2 10/2007 Keller
7,334,486 B1 2/2008 Klammler et al.
7,668,694 B2 * 2/2010 Anderson et al. ..... 702/182

(Continued)

OTHER PUBLICATIONS

Keller, C., et al, "Evaluation of the Potential Utility of Fluid Absorber Mapping . . . "; Proc. of the 7th Nat'l Outdoor Action Conf.; May 25, 1993; pp. 421-435; USA.

(Continued)

*Primary Examiner* — John Fitzgerald
(74) *Attorney, Agent, or Firm* — Rod D. Baker

(57) ABSTRACT

An apparatus and method for monitoring the water tables in boreholes, such as boreholes used as sampling wells for sampling contaminants in ground water. Fluctuations in one or more ground water levels can be monitored and recorded using transducers, and the changes in the water levels evaluated and considered, particularly in the context of sampling for contaminants where subsurface pollution remediation is contemplated or ongoing. The changes in ground water levels can be tracked in time and correlated, as desired, with the water sampling regime. The transducers used for monitoring pressure changes attributable to water table changes are located advantageously above the surface of the ground, where they are accessible for re-use, replacement, or repair. Apparatus and method for providing an air-coupling between the transducers and subsurface sampling points is disclosed.

20 Claims, 8 Drawing Sheets

U.S. PATENT DOCUMENTS

| | | | | |
|---|---|---|---|---|
| 7,841,405 | B2 * | 11/2010 | Keller | 166/264 |
| 8,069,715 | B2 * | 12/2011 | Keller | 73/152.28 |
| 2004/0065438 | A1 * | 4/2004 | Keller | 166/250.03 |
| 2005/0172710 | A1 * | 8/2005 | Keller | 73/152.41 |
| 2007/0260439 | A1 | 11/2007 | Keller | |
| 2008/0142214 | A1 | 6/2008 | Keller | |
| 2009/0003934 | A1 | 1/2009 | Keller | |
| 2009/0095066 | A1 | 4/2009 | Keller | |
| 2009/0211765 | A1 | 8/2009 | Keller | |

OTHER PUBLICATIONS

Keller, C., Improved Spatial Resolution in Vertical and Horizontal Holes . . . ; Remediation of Hazardous Waste Contaminated Soils; 1994; pp. 513-541; Macel Dekker, Inc.; USA.

Cherry, J.A., et al.; "A New Depth-Discrete Multilevel Monitoring Approach for Fractured Rock"; Ground Water Monit. & Remed.; 2007; pp. 57-70; vol. 27, No. 2; USA.

* cited by examiner

Fig. 4

$$\Delta WT = \Delta Pg/c + nRT(1/Po-1/Pg)/A$$

MONITORING THE WATER TABLES IN MULTI-LEVEL GROUND WATER SAMPLING SYSTEMS

CROSS-REFERENCE TO RELATED APPLICATIONS

This application claims the benefit of the filing of U.S. Provisional Patent Application Ser. No. 61/268,870, titled "Monitoring the Water Tables in Multi-level Ground Water Sampling Systems," filed on 17 Jun. 2010, and the specification thereof is incorporated herein by reference.

FIELD OF THE INVENTION

This invention relates generally to borehole liners, and more particularly to pore fluid sampling and other similar uses for everting flexible borehole liners, and specifically to the measurement of water table fluctuation histories at many elevations in a borehole.

BACKGROUND OF THE INVENTION

Flexible borehole liners are installed by the eversion process to seal a borehole against flow into or out of the borehole, which flow can cause the spread of ground water contamination. The installation method as commonly practiced propagates an everting borehole liner into the hole by adding water to the interior of the everting liner, which dilates the liner and, as the liner is everted into the borehole, causes the liner to displace the borehole fluids (usually water or air) into the adjacent surrounding subsurface formation. The installation of the liner, and/or its placement after installation, permits the gathering of a variety of useful data regarding subsurface conditions in the vicinity of the borehole. Aspects of the data-gathering process may include measuring or monitoring water level(s) in the borehole; some boreholes are in fact monitoring "wells." Helpful and general background regarding the utility and function of everting flexible borehole liners is provided by applicant's previously issued U.S. Pat. Nos. 5,176,207, 6,283,209, and 6,910,374, which are incorporated herein by reference.

Most water level measurements in traditional wells are performed by lowering a pressure transducer beneath the water surface to monitor the pressure history of water level changes. A multi-level sampling system in a single borehole does not allow such a simple measurement of the formation head at different levels in the formation. Previously known flexible liner systems for multi-level water sampling and head measurements in a single borehole use pressure transducers dedicated to the system and located significant distances (e.g., 100-200 feet) below the water table in a borehole in the geologic formation. Such pressure transducers monitor the hydraulic head in the formation at many different elevations. However, if one (or more) transducer should fail, the entire multi-level system must be removed from the borehole to access and replace the failed transducers. This removal, besides causing delay and expense, can result in damage to other functioning transducers, as well as to the flexible liner sampling system.

Flexible liner designs for a multi-level sampling system have been known for years, but previous designs have involved deep transducer locations, with transducers inaccessibly situated down-well, sometimes hundreds of feet, and more or less permanently dedicated to the system. Applicant's previously known "Water FLUTe" system is described at http://www.flut.com/sys 1.html, (incorporated herein by reference). Certainly the multi-level water sampling system has been improved beyond the teachings of applicant's U.S. Pat. No. 5,176,207, or of applicant's co-pending U.S. patent application Ser. No. 12/001,801 entitled "Pore Fluid Sampling System with Diffusion Barrier." The cost of removal and repair of failed transducers in known systems, however, can be a major expense of the design. Also, the dedication of the transducers to the system is a very expensive feature of the system, and the transducers are not available for reuse in other applications.

Improvements in transducer accuracy, and the recent addition of data recording capability in an individual transducer, increase significantly the practicality of the presently disclosed apparatus and method compared to systems using formerly utilized, less-accurate, transducers. That fact, coupled with the peculiar needs of the multi-level sampling system, were the background for the formulation of the useful devices and methods hereinafter disclosed.

SUMMARY OF THE INVENTION

There is disclosed hereby a method and associated apparatus for measuring the water level history at many levels in the formation surrounding a borehole. In the presently disclosed method and apparatus, however, all the pressure transducers are located at or above the Earth's surface where they are readily accessible. This change to conventional practice allows easy replacement of the transducers, or their reuse at other wells. The method also avoids the hazards to the transducers associated with emplacing transducers deep in the borehole during the multi-level system installation or removal.

Accordingly, there is provided a method and apparatus for measuring the water level history at many levels in a borehole in a subsurface geologic formation, with all of the pressure transducers located readily accessible near the surface. This improvement allows easy replacement of the transducers or their reuse at other wells. The method and apparatus disclosed hereby also avoids the hazards to the transducers associated with transducer emplacement deep in the borehole, during the multi-level system emplacement or during removal of the system. According to the invention, the transducers are connected to the sampling system by air-filled tubes. Changes in the air pressure in the tubes, and an associated air equation of state, are used with an algorithm to allow the water level changes deep in the formation to be accurately monitored. The present water level measurement method and apparatus, equipped with the air-coupled transducers, also may be conveniently calibrated, as desired, by manually measuring the water level for each water sampling elevation in the applicant's previously known "Water FLUTe" system. The present invention has a substantial beneficial effect on the cost, and therefore the overall utility, of known multi-level systems developed by the applicant. For a ten port system, this invention can reduce the long term cost of the multi-level sampling system by one half.

Additional objects, advantages and novel features of the invention will be set forth in part in the description which follows, and in part will become apparent to those skilled in the art upon examination of the following or may be learned by practice of the invention.

BRIEF DESCRIPTION OF THE DRAWINGS

The accompanying drawings, which are incorporated in and form a part of the specification, illustrate embodiments of the present invention and, together with the description, serve to explain the principles of the apparatus and method. In the drawings:

FIG. 4 is an algorithm usable to calculate changes in water table levels from pressure data obtained from the method and apparatus of the present invention;

Like numerals label like elements throughout the several views.

DETAILED DESCRIPTION OF A PREFERRED EMBODIMENT

Best Mode for Practicing the Invention

Figure 1:
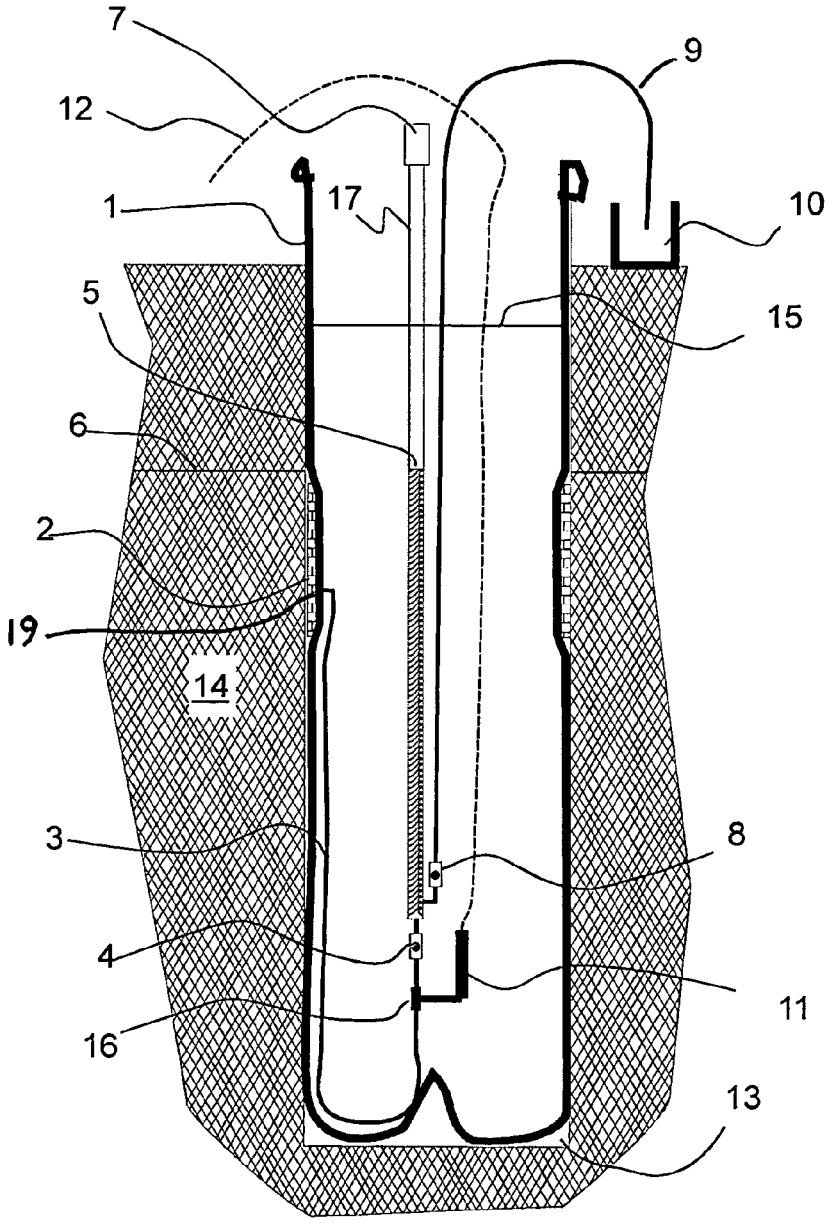
FIG. 1 is a diagrammatic view (not all elements to scale), in vertical section, of a prior-art multi-level sampling and monitoring system with transducers in a borehole deep below the ground surface.

Flexible liners in boreholes have been designed by the applicant as shown in FIG. 1 for the purpose of extracting from the borehole a ground water sample by gas displacement of the water in the tubing. Only a single port is shown in FIG. 1 for clarity of illustration; the entire tubing system seen in FIG. 1 is duplicated for additional sampling elevations located on and within the same liner.

The sampling and monitoring system usually is emplaced into the borehole by an eversion process known in the art. The continuous impermeable liner 1 is installed by eversion into a borehole 13 in the geologic formation 14 as described generally in, for example, U.S. Pat. No. 5,176,207. The liner 1 is pressurized by the liner's interior water level 15 being above the formation water level 6 in the adjacent geologic formation 14. Once emplaced, the sample tubing of the system fills with water from the formation 14. Ambient water in the formation 14 moves into the spacer 2. The formation water is conducted from the spacer 2 via the port 19 and the port tube 3, then through the first check valve 4, to fill the interior volume of the pump tube 17 until it reaches equilibrium level 5 with the existing water level 6 in the formation 14. The formation water level 6 can be determined by lowering an electric water level meter through the top 7 of the pump tube 17 to the water surface at pump tube water level 5. Water in the pump tube 17 is pumped to the surface by application of a gas pressure at the top 7 of the pump tube 17. Upon application of such a sufficient and regulated gas pressure, the first check valve 4 closes, and the water in the pump tube 5 is expelled through the second check valve 8, through the sample tube 9, and to the surface container 10 (e.g., for sampling analysis).

In previously known systems, a continuous history of the water pressure in the formation 14 is obtained by monitoring a pressure transducer 11 connected to the port tube 3 and situated beneath the first check valve 4, at the connection location 16 seen in FIG. 1. Connection location 16 ordinarily is underwater, and often is a hundred feet or more below the ground surface. The transducer's electrical connection to the surface is via the cable 12. The immediately foregoing design and function typifies the current multi-level sampling and formation water pressure measurement system. The problem addressed by the inventive multi-level system described hereinafter is that the transducer 11 is not easily accessible for removal for reuse or repair. Also, the dedication of the expensive transducers (e.g., five to fifteen transducers 11 per system) is a major investment in a multi-port system.

Figure 2:
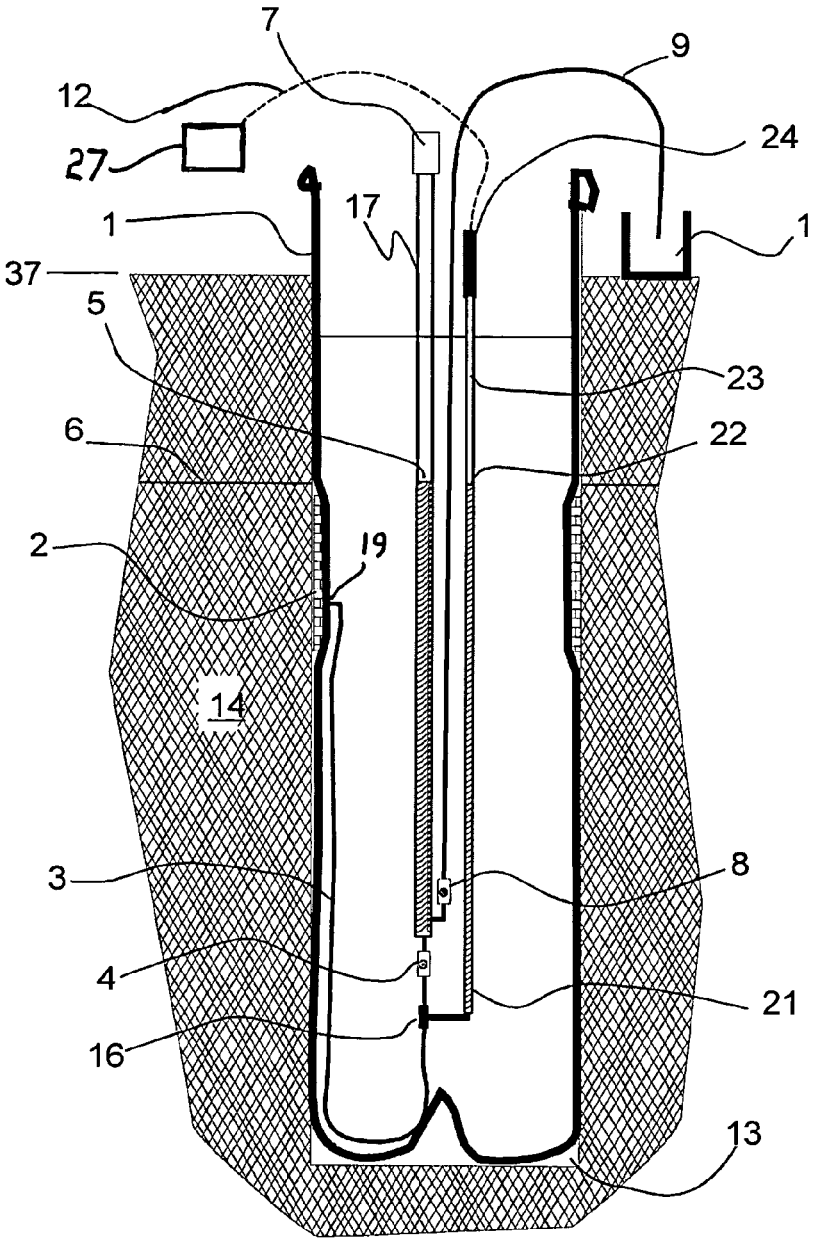
FIG. 2 is a diagrammatic view (not all elements to scale), in vertical section, of a multi-level sampling and monitoring apparatus according to the present invention, with transducers above the ground surface.

Attention is invited to FIG. 2, showing the presently disclosed apparatus and method. While there are numerous ports 19, and numerous sampling, pumping, and pressure monitoring tubing systems (including collectively 2, 3, 4, 8, 9, 17, 21, 24) in a typical multi-level sampling and monitoring system, for the sake of simplicity of expression only one sampling and pressure measurement tubing system is described. Description of one sampling and pressure measurement system according to the present invention suffices to describe a plurality. It is understood by any person skilled in the art that a complete monitoring system may and normally will have a plurality (often up to fifteen, sometimes even more) of sampling and pressure measurement tubing assemblies disposed in a given borehole.

The complete sampling system of FIG. 2 is a non-obvious improvement to that illustrated in FIG. 1. In the apparatus of FIG. 2 a transducer tube 21 is connected to the port tube 3 at the connection location 16. The transducer tube 21 extends to the surface at the top of the borehole 13. The water in the transducer tube 21 rises to level 22 (as it likewise rises to the elevation 5 in the pump tube 17). The upper portion of the transducer tube 21 above the water level 22 is filled with a columnar volume of ambient air 23 (a typical gas, although other gasses could be supplied). After the water level 22 in the transducer tube 21 has equilibrated with the water level 6 in the formation 14, a pressure transducer 24 having a pressure low range (e.g. 30 psi) and high resolution (e.g., ±0.05% of full scale) is securely connected with a gas-tight seal to the top end of the transducer tube 21. This sealing action defines and establishes the original or baseline water level 22, the original gas volume 23, and the initial gas pressure in the transducer tube 21. After several hours have elapsed, the relative humidity in the transducer tube gas volume 23 approaches equilibrium with the water surface 22 (at the temperature of the interior of the borehole 13). At that time, the elevation of the water level 5 in the pump tube 17 is measured. At the same time, the gas pressure in the upper portion of the transducer tube 21 is noted and recorded; this is the initial baseline pressure condition of the gas volume 23 in the upper portion of the transducer tube 21, when the initial water level in the formation 14 is at level 6, as measured at pump tube water level 5.

In time, the water level 6 in the formation 14 typically changes. It often is desirable to monitor and consider such changes. According to the invention, the water level 22 in the transducer tube 21 tends to follow or "track" the fluctuations in the formation water level 6. However, if the water level 22 in a transducer tube 21 rises, for example, the air column 23 in the interior volume of the upper portion of the transducer tube 21, above the water level 22, tends to be compressed. Such compression resists the further rise of the water level 22 in the transducer tube 21, hampering the achievement of complete equilibration with the formation water level 6. In such case, neither the water level 22 in the transducer tube 21, nor the pressure increase in the air column 23 in the upper portion of the transducer tube, is a direct indication of the change in water level 6 within the formation 14. Nevertheless, by accounting physically and mathematically for both the change of the water level 22 in the transducer tube 21 and the pressure change measured in the air column 23 in the transducer tube upper portion (adjacent the transducer 24), an elevation change to a new water table level 6 in the formation 14 can be determined with reasonable accuracy.

By measuring the air pressure of the air column 23 within the upper portion of the transducer tube 21, a user of the present invention can deduce or calculate the rise and the fall of the formation water table 6. This method and apparatus configuration allows the transducer 24 to be located at or near the surface at the top of the borehole 13, where it can be easily repaired if needed, or reused at another installation. The easier access for repair may greatly reduce the cost of the warranty services to the transducers 24 deployed in a particular monitoring system according to the present disclosure.

Figure 3:
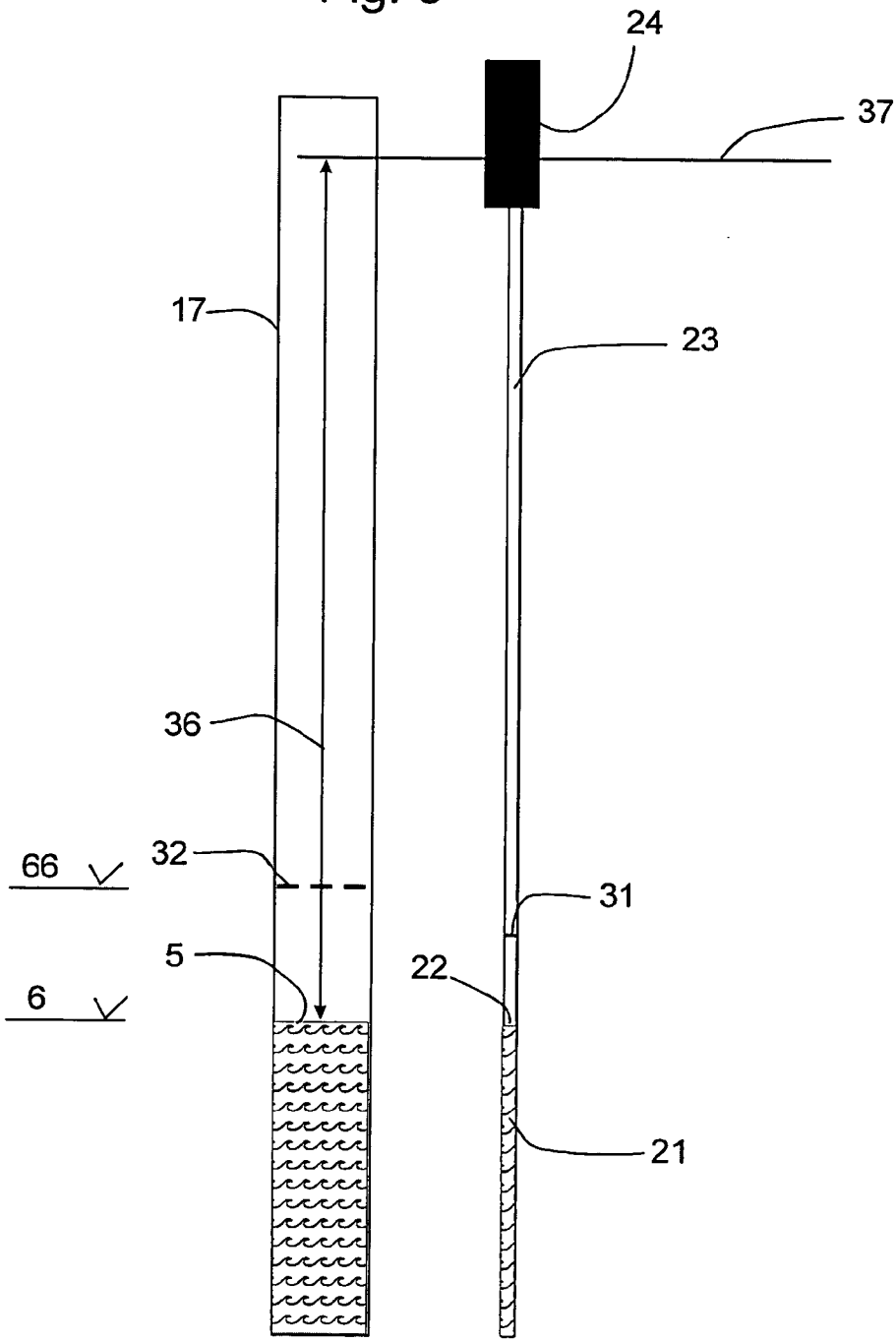
FIG. 3 is a schematic side view depicting the geometry of a monitoring system apparatus according to the present invention.

Referring additionally to FIG. 3, fundamental aspects of the configuration and function of presently disclosed apparatus and method are: The original gas volume 23 in the upper portion of the transducer tube 21; the elevation of the water level 5 in the pump tube 17; and the barometric air pressure above the ground surface 37 at the time the transducer 24 is sealably attached to the top end of the transducer tube 21. The initial gas volume 23 is simply calculated from the known inside diameter of the transducer tube 21, the water level 22 below the reference level 37, and the elevation of the transducer 24 connection. (At initial conditions, the fluid levels 5 and 22 are approximately the same elevation.) The barometric pressure at the surface is measured with an independent transducer (not shown) located above the surface of the formation 14.

The pressure at the connection 16 to the pumping system (seen in FIG. 2) is equal to the hydrostatic head from that elevation at connection position (16) to the water table 6 in the formation 14, plus the barometric pressure above the water table. The pressure at elevation of connection 16 also is equal to the hydrostatic head from that connection 16 to the water level 5 in the pump tube 17 (which can be measured as the distance 36 measured from the formation surface with an electric water level meter), plus the barometric pressure at the surface 37. The pressure at the connection 16 also is equal to the hydrostatic head of the current water level 22 in the transducer tube 21, plus the gas pressure in the air volume 23 above the water level 22 in the transducer tube 21. It is noted that the water level 5 in the pump tube 17 will not follow formation water level 6 if the formation water level 6 drops at a later time, due to the function of the check valve 4 below the bottom end of the pump tube. However, for the ease of this description, it is assumed that the water level will remain constant or rise. If the water level 6 should fall, the pump tube 17 can be purged to allow the pump tube water level 5 to decrease to match the formation water level 6.

FIG. 3 illustrates diagrammatically the principal aspects of the hydraulic function of the presently disclosed apparatus and method. If the water level 6 in the formation 14 rises to a new formation level 66, the water level 5 in the pump tube 17 likewise rises to a new pump tube level 32 equal to the new formation level 66. However, the water level 22 in the transducer tube 21 rises to a new transducer tube level 31 which is lower than the new level 32 in the pump tube 17. The lesser rise in the transducer tube water level is due to the closed gas volume 23, which gas is compressed by the water rising in the transducer tube 21. As the pressure in the gas volume 23 increases, it resists any rise in the transducer tube water level 31.

By adding the hydrostatic head in the transducer tube 21 to the pressure in the gas volume 23, and equating it to the hydrostatic head in the formation 14 (which equals the head at the accessible pump tube level 5), one can solve for the water table level 6 in the formation 14 as a function of the gas pressure in volume 23 of the transducer tube 21 (as measured by the transducer 24). This is possible because a change in the gas pressure in the upper portion of the transducer tube 21 is directly related to a change in the gas volume 23, which in turn is directly related to the transducer tube's water level rise to new level 31. Therefore, both the new water level 31 and the pressure in the gas volume 23 can be determined from the gas pressure measurement at the transducer 24. Notably, the new water level 31 in the transducer tube 21 does not match the new water level 32 in the pump tube 17 after the change in the formation water level 6. Despite this difference, the new formation water level 66 can be determined from the change in pressure in the transducer gas volume 23. In the course of the practicing of the invention, the pressure values measured by the transducer 24 are periodically or continually recorded for input into algebraic formulae for calculating water level changes. Differences in water level in the formation, such as a rise in formation water level from a selected first level 6 to an immediately subsequent level 66, can be determined from the difference between the corresponding measured gas pressures in the upper portion of the transducer tube. Correspondence is provided by time correlation.

FIG. 4 is an algebraic expression of the result of equating the pressure in the tube tubes 21 to the pressure at the level of connection 16 and that relationship to the water level 66 in the formation 14. The expression of FIG. 4 permits the calculation, from the measured pressure change in the gas volume 23, of a change in elevation (e.g. to 66) of the formation water level 6. In the equation of FIG. 4, $\Delta WT$ is the change in the formation water level from its first (e.g., initial) level (i.e., 6 in FIG. 3) to a second subsequent level (e.g., 66 in FIG. 3), $\Delta Pg$ is the measured change in gas pressure in the transducer tube upper portion gas volume 23 due to the change in fluid level from the first level 6 to a second level 66, c is a constant to convert from pressure to hydraulic head, n is the number of moles of gas in the gas volume 23 in the transducer tube, R is the universal gas constant, T is the absolute temperature, Po is the initial absolute pressure in the transducer tube 21, Pg is the subsequent absolute pressure measured by the transducer 24, and A is the cross sectional area of the transducer tube 21 at the new water level 31 in the tube. As is convenient, the user can test check the calculated water level 6 by comparing it with the new level 32 measured in the pump tube 17.

It is noted that to determine correctly the current water level (i.e., as changed from the baseline level) in the transducer tube 21 from the gas pressure in volume 23, one must employ a representative equation of state for the gas to determine a volume change from the gas pressure change. For this illustration, the simple ideal gas equation of state, $PV=nRT$, was used, where P is the absolute pressure, V is the gas volume 23 in the transducer tube, n is the number of moles of gas in the volume 23, R is the universal gas constant, and T is the absolute temperature. Other equations of state may be useful for higher resolution. The number of moles of gas, n, is determined from the initial conditions at the moment the transducer 24 initially is connected to the transducer tube 21. It is worthy of further note that variations of the barometric pressure on the water surface at level 5 in the pump tube 17, and also on the water table surface at formation level 6, can cause changes in the water level 22 in the transducer tube without any change in the actual formation water level 6. For that reason, the pressure measured by the transducer 24 in the gas 23 in the upper portion of the transducer tube 21 preferably is corrected for changes in the barometric pressure, in order to not confuse atmospheric barometric pressure effects with a change in the formation water level 6.

The foregoing mathematical formulae are known from gas physics, and are not unique to the present invention. The data processing procedure includes obtaining the periodically or continuously recorded pressure (and temperature) history from the transducer 24, via the transducer cable 12, and entering that data together with the original or initially measured baseline parameters (as described above) for the calculation, by the equation of FIG. 4, of the system response. Measured raw data may be input into a digital computer processor 27 for rapid calculation of ΔWT by routines known or readily provided by the software programming arts. The net result is the compiled history of the formation water level 6 for each port 19 for which an air-coupled transducer tubing system has been employed. It is preferable that the data reduction process is convenient for the method to be practical.

Of further note is that the number of moles, n, of gas in volume 23 is modified slightly by the effect of water vapor evolving, with changes in temperature or pressure, from the surface of the water 22 and into the air volume 23 in the upper portion of the transducer tube 21. This effect has been measured to be most significant at the time the transducer 24 is first attached to the tube 21, when the air in the tube volume 23 is not fully saturated with water vapor. After the relative humidity in the closed air volume 23 has been permitted to stabilize, the effect of water vapor pressure changes is small. Still, it is preferable to maintain the transducer 24 at a relatively constant temperature to minimize the temperature effects, even though the transducer 24 typically records both pressure and temperature at the transducer's location.

Again, the tubing system described with reference to FIGS. 2 and 3 may be reproduced for several different port elevations, and their associated sampling systems, within a single flexible liner 1 for a multi-level sampling system in a common borehole 13. These several tubing systems are bundled in the interior of the liner 1 and the several transducers 24 are located at the top of the borehole, with one tubing system assembly associated with each respective spacer 2 and port 19 through the liner 1. Each tubing system assembly in the plurality has an associated spacer 2 with an adjacent port 19 permitting fluid to enter an associated port tube 3 through which fluid is transported to the tube connection 16. Each tube system assembly likewise includes a pump tube 17, a sample tube 9, and a transducer tube 21, as well as a transducer 24 and other associated components such as check valves 4 and 8 as described above. Accordingly, it is understood by a person skilled in the art that in a preferred embodiment of the invention, a single borehole 14 may have a plurality of tubing system assemblies installed within the common flexible liner 1 situated in the borehole. Each tube system assembly is substantially similar to the others in the plurality, except that the spacer 2, port 19, and connection 16 for each tube system assembly are disposed at a different borehole elevation. The transducer 24 corresponding to each tube system assembly is at the ground surface for easy access.

Figure 5:
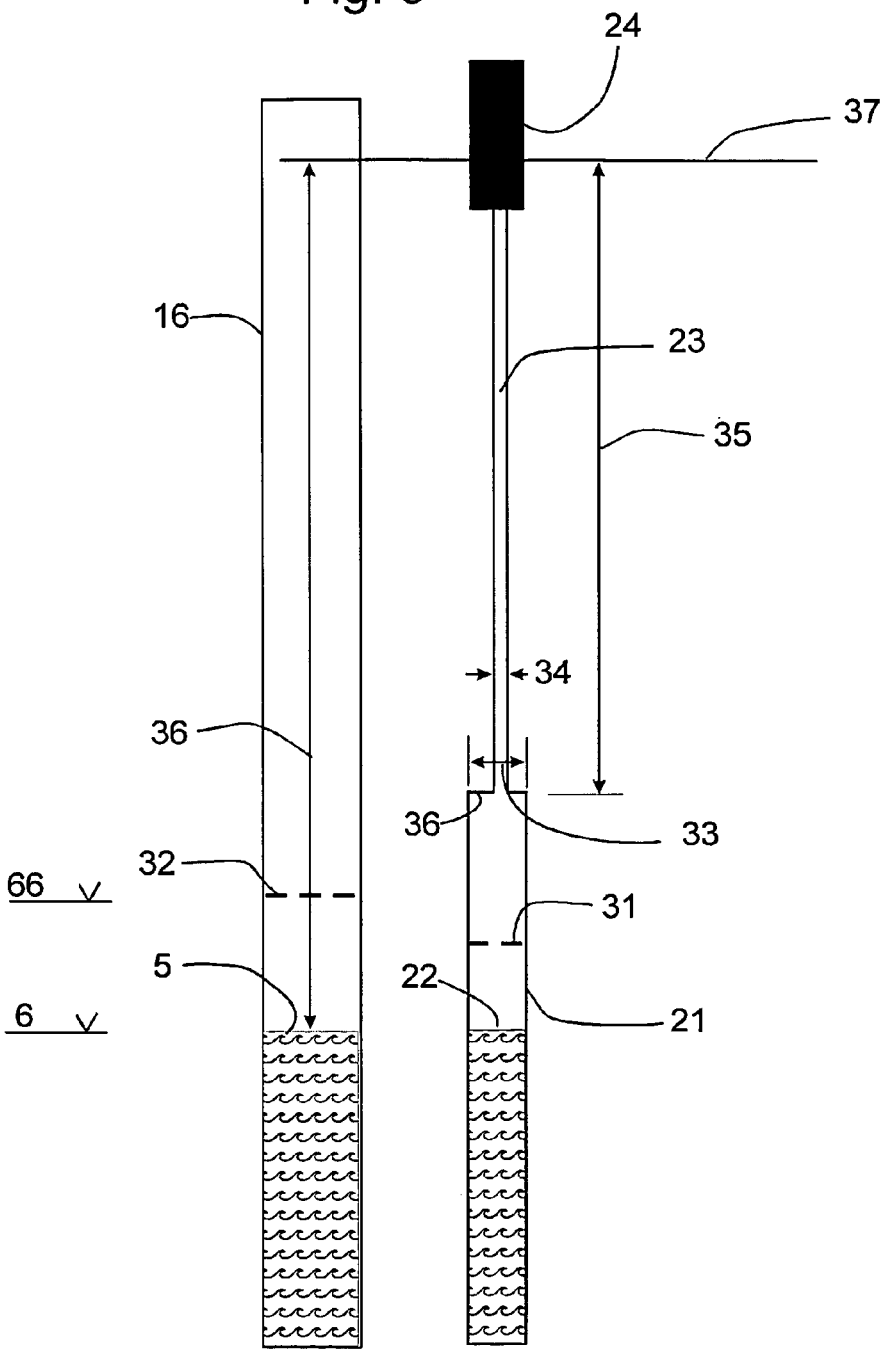
FIG. 5 is a schematic side view, similar to that of FIG. 3, depicting the geometry of an alternative embodiment of a monitoring system apparatus according to the present invention, having a transducer tube specially configured to increase the sensitivity of pressure change measurements.

FIG. 5 shows an embodiment having a similar tubing geometry to the embodiment of FIG. 3, except that a dilated first portion of the transducer tube 21 features a greater diameter, extending up to a transition elevation 36. Below the transition elevation 36, the dilated portion of the transducer tube 21 has a first diameter 33 that is larger than the second, smaller diameter 34 of the tube above the transition elevation 36 at a distance 35 below the surface 37. The narrow portion of the tube 21 having the smaller diameter 34 extends up to, and is connected to, the transducer 24. With the use of a lower dilated tube segment having a diameter 33 substantially larger than a diameter 34 of an upper narrow tube segment, a change in the transducer tube water level from a first level 22 to a second level 31 produces a comparatively larger change in gas pressure in the upper tube gas volume 23. This relatively larger change is due to the ratio of the volume change in the dilated portion of tube 21 to the original volume 23 in the higher, narrow portion of the tube being greater for a given incremental change of the water level (e.g., first level 22 to second level 31), than the one-to-one ratio if the transducer tube has a constant diameter. It is observed here that the calculation of the initial gas volume 23 in this embodiment requires a slightly different formula than the formula for a simple cylinder of constant diameter, to account for the affect upon volume 23 of the differing diameters (i.e., 33, 34).

The pressure amplification geometry of FIG. 5 is especially helpful for practicing the invention in very deep water tables, in which the air-filled volume 23 in the transducer tube 21 is large relative to that for shallow water tables. The dilated geometry is helpful because the resolution of a pressure change depends upon the fractional change in gas pressure. A deep water table has a relatively larger initial volume of gas in volume 23, hence the advantage of the larger volume change with a dilated tube at the levels 22 and 31. The use of a second upper portion of the tube having a smaller diameter 34 at the transducer 24 also minimizes the undesirable effect of a temperature change at the top of the borehole 13, because the gas volume affected by the temperature change in the second, narrow portion of the tube 21 having the smaller diameter 34, is small relative to the total gas volume contained in the volume 23, which includes gas contained in the dilated portion of the tube below the transition level 36.

Figure 6:
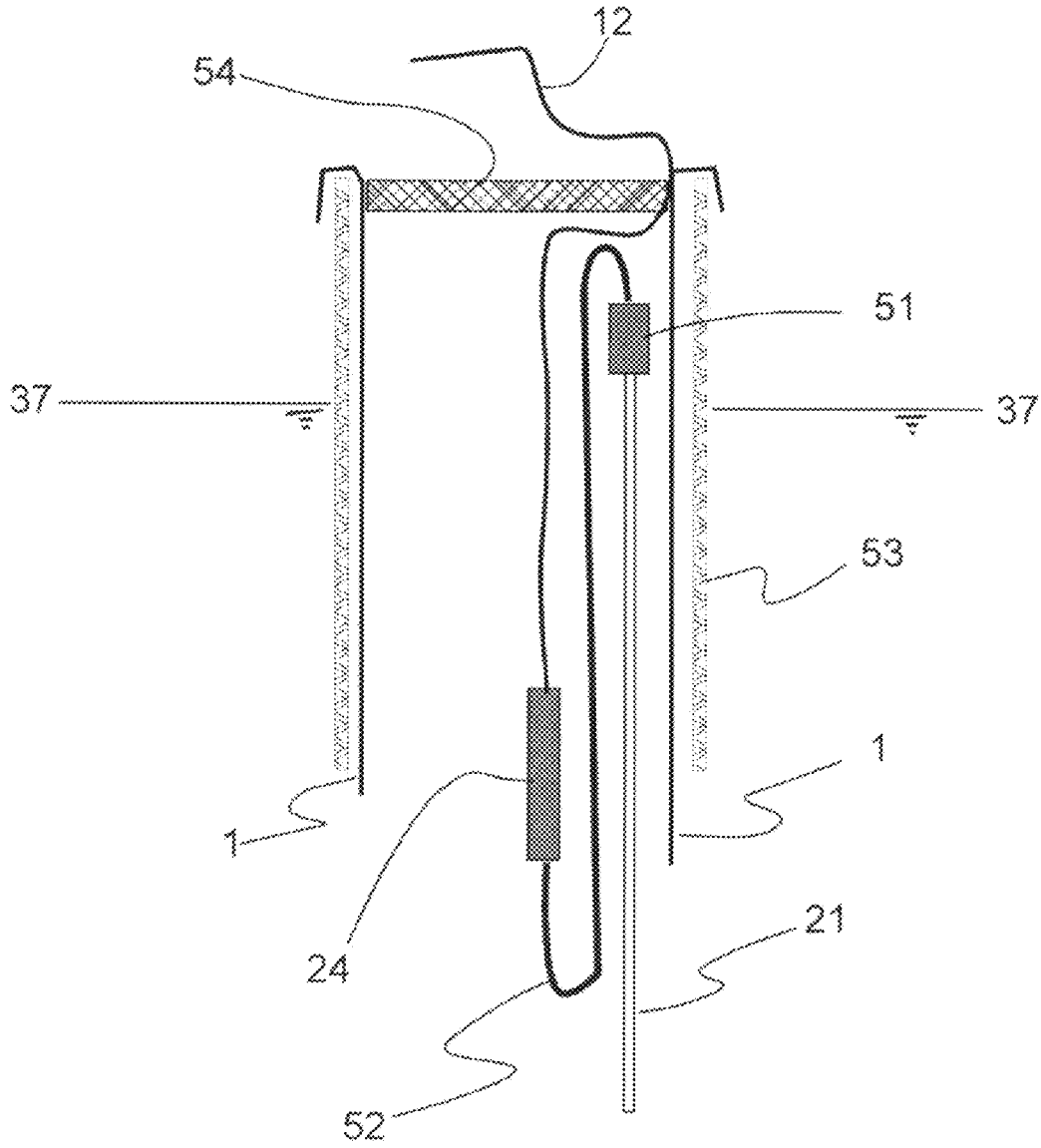
FIG. 6 is a schematic side view of a portion of an alternative embodiment of a monitoring system apparatus according to the present invention, showing the protected location of the pressure transducer.

Because it is convenient to locate the transducers in the top of the borehole 13, a tubing geometry at the ground's surface such as that depicted in FIG. 6 allows easy access to a disengageable connecting union 51 which fluidly couples the transducer 24 to the transducer tube 21 via a very flexible, small-diameter intermediate tube 52. In this embodiment, the transducer 24 can be lowered into the protective interior of the well casing 53 (and inside the liner 1) prior to the engagement of the union 51. It is desirable to provide the transducer, and at least a portion of the upper portion of the transducer tube 21 (particularly that upper portion containing the gas volume 23) with an insulated enclosure. The interior of the borehole, within the casing 53, is at a more nearly uniform temperature than the outside environment above the surface 37. Further, it is preferable to maintain the interior of the casing 53 at a relatively uniform temperature, to reduce the temperature effects on the air volume 23 in the transducer tube. A layer of insulating material 54, for example a rigid foam, may be placed in the top of the casing 53 to prevent large temperature effects within the casing interior due to thermal variations in the atmosphere above the casing. Other insulation geometries or enclosure means may be more useful for different wellhead configurations.

Figure 7:
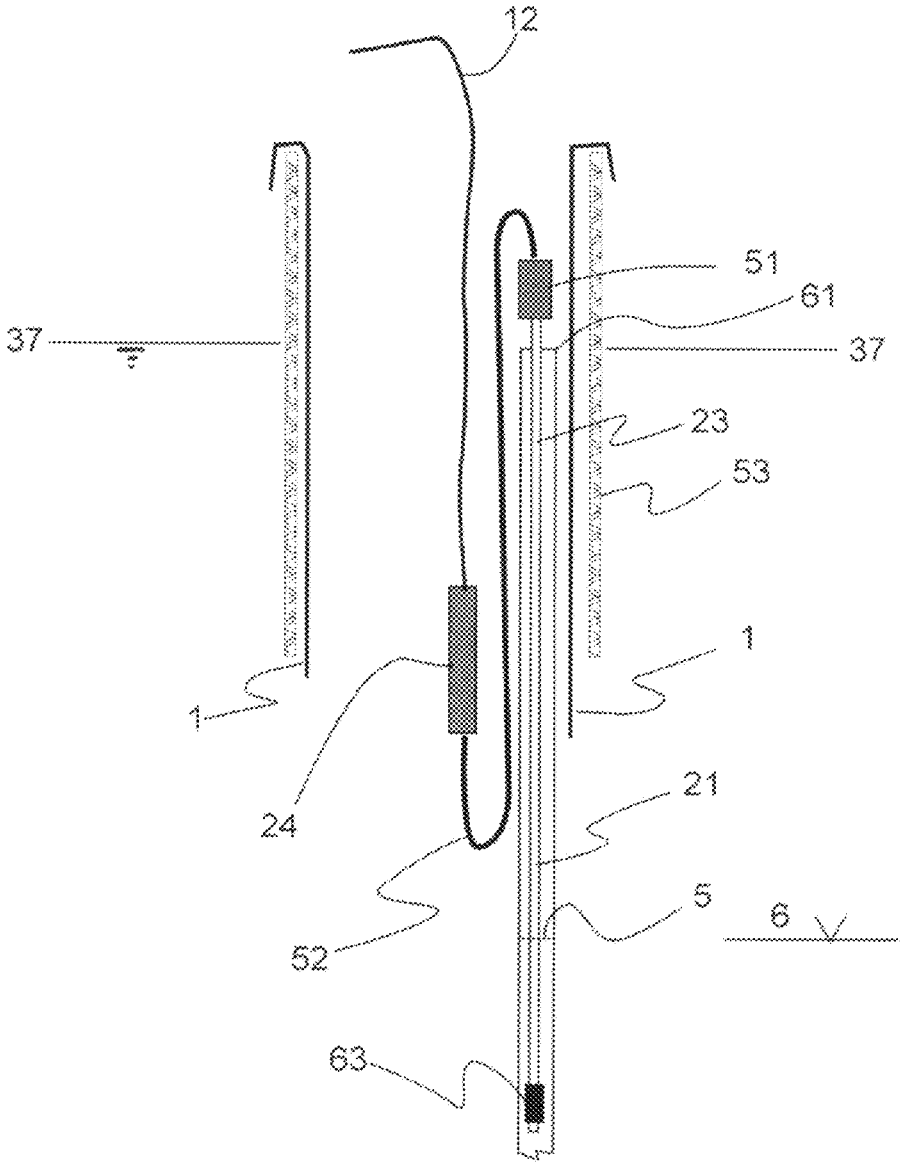
FIG. 7 is a schematic side view of a portion of an alternative embodiment of a monitoring system apparatus according to the present invention, showing the protected location of the transducer tube in an open slender casing.

Yet another alternative embodiment of the apparatus and method seen in FIG. 7 involves lowering the transducer tube 21 into a slender tube or small-diameter well casing 61 (e.g., the pump tube 17). The diameter of the slender casing 61 is less than adequate to allow the installation of a pressure transducer 24 beneath the water level 5 in the slender casing 61. Thus, in order to determine the original water level 5, the water level 5 in the slender casing 61 must be measured before the transducer tube 21 is lowered into the slender casing 61. For this geometry to be effective in a pump tube 17, the check valve 4 (FIG. 2) is removed from the system to allow the fluctuations in the water level 5 to "track" or follow the formation water level 6. Also, the number of moles of gas 23 in the transducer tube 21 will be that contained in the tube before it is lowered into the water in the slender casing 61. A weight 63 disposed on the bottom of the transducer tube 21 may be required to prevent the transducer tube from floating or rising due to the buoyancy of the air trapped inside the tube.

Another possible alternative embodiment of the present apparatus and method includes the sealed attachment of the transducer 24 directly (or via a short coupling tube) to the top 7 of a pump tube 17 (or similar slender tube or casing 61) for monitoring water level fluctuations. However, the conditions and environment at the ground's surface need to be stable or controlled so that temperature changes at the transducer 24, or in the air volume in the tube 21 connected to the transducer 24, are minimal so as not to be detrimental to the measurement accuracy. Also, it is important that the transducer tube 21 must be nearly absolutely air tight; there very preferably exists no loss, or gain, of gas in air volume 23 in the upper portion of the transducer tube 21, which fluctuations can cause a gas pressure change, over time, that is unrelated to changes in the formation water level 6.

Figure 8:
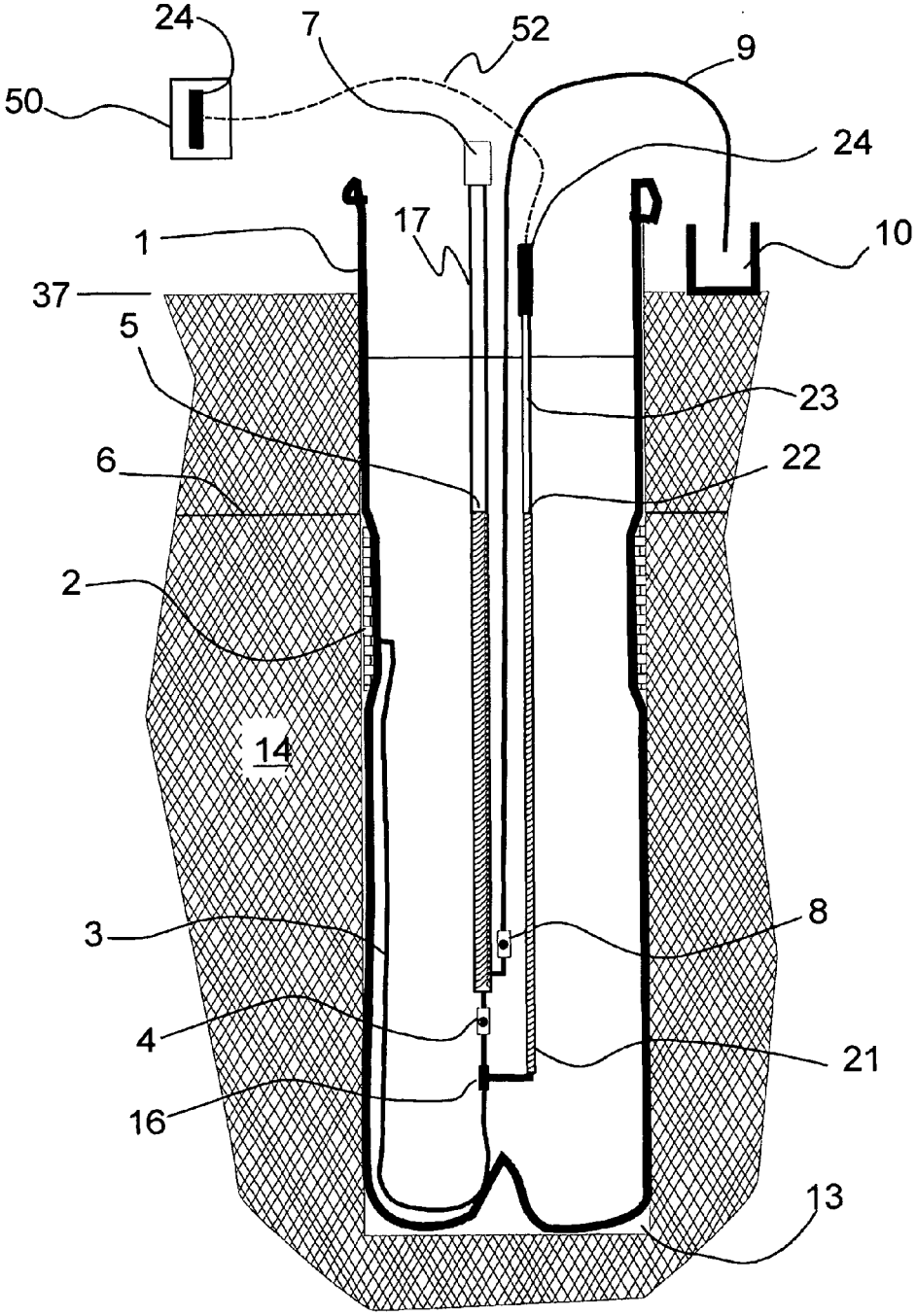
FIG. 8 a diagrammatic view (not all elements to scale), in vertical section, of a multi-level sampling and monitoring apparatus according to the present invention, with transducers above the ground surface but in a protective housing outside the borehole.

Another useful variation on the present design and process locates the transducer 24 in a nearby volume (e.g., enclosed housing near the top of the borehole 13) protected from temperature effects, which does not include the placement of the transducer in the volume of the well casing or borehole. For example, as seen in FIG. 8, a protective enclosure for the transducer 24 features a thermally insulated housing 50 located outside the borehole well casing (53 in FIG. 6). The disconnectable connecting union 51 is sealed secured to the top of the transducer tube 21 within the borehole well casing. An intermediate tube 52, well thermally insulated, extends between the transducer 24 and the disengageable connecting union 51. The transducer 24 thus is located within the insulated housing 50 and is in fluid communication with the top of the transducer tube 21 via the connecting union 51 and intermediate tube 52.

Accordingly, there is disclosed by collective reference to the drawing figures an apparatus for monitoring changes in the level 6 of a fluid (typically ambient water) in the formation 14, there being the borehole 13 extending into the formation 14 from the formation surface 37, with the apparatus having one, and preferably more than one, tubing system. A tubing system according to the apparatus includes the transducer tube 21 extending in the borehole 13 and having its top end located above or near the formation surface 37, and its bottom end below the fluid level 6 in the formation 14. Each tubing system also has the transducer 24 positioned above the formation surface 37 and in closed fluid communication with the top end of the transducer tube 21, whereby the gas pressure within the volume 23 in the upper portion of the transducer tube 21 can be measured. The transducer tube 21 is together with the port tube 3, the latter being in fluid communication with the fluid in the formation 14, and also in fluid communication with the bottom end of the transducer tube 21. Fluid flows, via the port tube 3, between the formation 14 and a lower portion of the transducer tube 21, whereby the level 22 of the fluid in the transducer tube 21 tends to equilibrate with the existing level 6 of the fluid in the formation 14. Further to a key feature of the apparatus, the level 22 of fluid in the transducer tube 21 affects the gas pressure within the upper portion of the transducer tube; a change in fluid level within the transducer tube 21 (e.g., from first level 22 to second level 31) changes the pressure in the gas volume 23, as measured by the transducer 24, to indicate the change in the level of the fluid in the formation 14 (e.g., from first formation level 6 to second formation level 66).

The very preferred embodiment of the apparatus has the flexible liner 1 that is everted into the borehole 13 at least to a depth below the level 6 of the fluid in the formation 14. The liner 1 substantially seals the borehole walls against the flow of fluid between the formation 14 and the borehole interior to the liner 1, except where ports 19 are provided (adjacent spacers 2 on the outside of the liner 1). The transducer tube 21 and the port tube 3 are situated within the interior of the everted flexible liner 1.

The apparatus very preferably also provides a means for sampling ambient fluid from the formation 14. The sampling means is a part of the tubing system, and includes the pump tube 17 within the everted flexible liner 1, the top end 7 of the pump tube 17 being above the formation surface 37 and the bottom end being below the level 6 of the fluid in the formation 14; the pump tube bottom end also is in fluid communication with the port tube 3. There is also provided in the tubing system the sample tube 9 at least partially within the everted flexible liner 1 and having a top end above the formation surface 37 and a bottom end in fluid communication with the bottom end of the pump tube 17. Each port 19 is defined through the everted flexible liner 1 at a sampling location elevation and in fluid communication with the port tube 3, whereby fluid in the formation 14 flows into the pump tube 17 via the port 19 and port tube 3. In the sampling means there is the check valve 4 between the bottom end of the pump tube 17 and the port tube 3 for regulating (preventing) fluid backflow from the pump tube 17 into the port tube 3. When a gas pressure is supplied to the top end 7 of the pump tube 17, the check valve 4 closes and a fluid sample from within the pump tube 17 is expelled above the formation surface 17 via the sample tube 9.

Returning attention more particularly to FIG. 5, an alternative embodiment of the apparatus has the transducer tube 21 featuring a dilated portion having a first diameter 33, extending from the level of the fluid in the formation 6 (a level approximately equal to the fluid level 22 in the tube) up to the transition elevation 36, and a narrow portion, above the transition elevation 36, having a second diameter 34 smaller than the first diameter 33 of the dilated portion. The narrow portion of the transducer tube extends up to, and connects to, the transducer 24. Accordingly, a change in the fluid level (e.g. 22) within the dilated portion of the transducer tube 21 creates an amplified change in gas pressure within the narrow portion of the tube proportional to the difference between the first 33 and second 34 diameters.

The apparatus in alternative embodiments has an enclosure about the transducer 24 for insulating the transducer 24 from deleterious temperature changes. Referring again to FIG. 6, one version of the enclosure is composed of the borehole well casing 53, and the layer of insulating material 54 disposed across the top opening of the casing. In this embodiment, the transducer 24 is fluidly connected to the transducer tube 21 via the disconnectable connecting union 51 and the intermediate tube 52. This way, the transducer 24 is removably disposable within the well casing 53 prior to the disposition of the layer of insulating material 54, but remains protected yet easily accessible at the surface 37 of the ground.

Alternatively, the transducer enclosure may be a thermally insulated housing 50 located outside the borehole well casing 53, yet quite proximate to the top of the borehole 13, as suggested in FIG. 8. The disconnectable connecting union 51 is at the top of the transducer tube 21. The transducer is within the protected confines of the housing 50. The transducer 24 is in fluid communication with the transducer tube 21 via the connecting union 51 and a heavily insulated intermediate tube 52.

The embodiment of FIG. 7 manifests an enclosure about the transducer tube 21 for enclosing the transducer tube, wherein the enclosure is the slender casing 61 within the borehole well casing 53 and around the transducer tube. In certain instances, it may be desirable to deploy a pump tube 17 but without a sample tube 9, and with no check valve 4. Such an alternative configuration permits the use of a different pumping system, and the water level in the pump tube 17 follows the water table level 6 without the need for purging. The transducer 24 is in fluid communication with the transducer tube 21 via the disengageable connecting union 51 (which is sealably attached to the top of the transducer tube), and an intermediate tube 52 extending between the transducer 24 and the connecting union 51. Element 61 is a slender casing (e.g., about ½-inch inside diameter) which can be sampled, but the air-coupled tube 21 lowered into the casing 61 allows the water level to be monitored. Normally, the casing 61 is too small to allow the transducer 24 to be lowered into the water (5) in the casing. For example, the tube 21 may be lowered into the pumping tube 17 in situations where there are no current transducers in the system. The main feature of this embodiment is the air-coupled transducer geometry shown in the FIG. 7.

In most practical and preferable embodiments of the apparatus, there is a plurality (e.g., two to fifteen, typically between five and ten) of tubing systems (including at least the port tube 3 and transducer tube 21 and associated ports, connections, and valves as described) within a single borehole 13.

The methodology of the invention is apparent from the foregoing, but is here summarized. The method for monitoring changes in the level 6 or 66 of a fluid in a formation 14, (there being a borehole 13 extending into the formation 14 from a formation (ground) surface 37, includes the basic step of situating at least one tubing system in the borehole 13. This step of situating at least one tubing system features the steps of extending a transducer tube 21 in the borehole 13 such that a top end of the transducer tube is above the formation surface 37 and a bottom end of the transducer tube is below the fluid level 6 in the formation, disposing a transducer 24 above the formation surface 37 and in closed fluid communication with the top end of the transducer tube 21, providing a port tube 3 in fluid communication with the fluid in the formation 14 and with the bottom end of the transducer tube 21, allowing fluid to flow, via the port tube 3, between the formation 14 and a lower portion of the transducer tube 21 whereby a level of the fluid in the transducer tube tends to equilibrate with the level of the fluid in the formation, permitting any change in the level 22 of fluid in the transducer tube 21 resulting from a change in the level 6 of the fluid in the formation 14 to affect the gas pressure within an upper portion of the transducer tube (any change in gas pressure indicating a change in the level of the fluid in the formation, and measuring with the transducer 24 a change in the gas pressure within the upper portion of the transducer tube.

The method preferably also has the steps of everting the flexible liner 1 into the borehole 13 to at least a depth below the level 6 of the fluid in the formation 14 to substantially seal, with the liner, the borehole walls against the flow of fluid between the formation 14 and the borehole interior to the liner 1, and (simultaneously or subsequently) situating the transducer tube 21 and the port tube 3 within the interior of the everted flexible liner.

To enable fluid sampling processes, the method includes disposing a pump tube 17 within the everted flexible liner 1 such that a top end 7 of the pump tube is above the formation surface 37 and a bottom end of the pump tube is below the level 6 of the fluid in the formation 14. The bottom end of the pump tube 17 is placed in fluid communication with the port tube 3, and a sample tube 9 is situated within the everted flexible liner 1 such that a top end of the sample tube is above the formation surface. The bottom end of the sample tube 9 is placed in fluid communication with the bottom end of the pump tube 17. This method includes the provision at a sampling location elevation of a port 19 through the everted flexible liner 1 and in fluid communication with the port tube 3, thereby allowing fluid in the formation 14 to flow into the pump tube 17 via the port 19 and the port tube 3, and the disposition of a check valve 4 between the bottom end of the pump tube and the port tube, and thereby regulating with the check valve the flow of fluid from the pump tube into the port tube. By supplying a gas pressure to the top end 7 of the pump tube 17, thereby closing the check valve 4 and expelling, via the sample tube 9 and to above the formation surface 17, a fluid sample can be retrieved from within the pump tube 17 for analysis at the ground's surface 37 or in a remote laboratory.

A key act is the step of determining, from a measured change in the gas pressure within the volume 23 within the upper portion of the transducer tube 21, a change in the level of fluid in the formation 14. This determination fundamentally is the calculation of the change in level of fluid by using the formula $$\Delta WT = \frac{\Delta Pg}{c} + \frac{nRT\left(\frac{1}{Po} - \frac{1}{Pg}\right)}{A}$$

in which ΔWT is the change in the formation fluid level, ΔPg is the measured change in the gas pressure in the upper portion of the transducer tube, c is a constant (known from the art of gas or hydraulic physics) to convert from pressure to hydraulic head, n is the number of moles of gas in the upper portion of the transducer tube, R is the universal gas constant, T is the absolute temperature, Po is a first absolute pressure in the transducer tube, Pg is a subsequent second absolute pressure in the transducer tube, and A is a radial cross sectional area of the transducer tube.

In the method, extending a transducer tube 21 optionally means defining in the transducer tube a dilated portion, having a first diameter 33 extending from the level of the fluid in the formation up to a transition elevation 36, and defining a narrow portion above the transition elevation 36, having a second diameter 34 smaller than the first diameter of the dilated portion, and extending the narrow portion up to, and connecting the narrow portion to, the transducer 24. In this version of the method, any change in a fluid level within the dilated portion of the transducer tube creates an amplified change in gas pressure within the narrow portion, the amplification being substantially proportional to the difference between the first and second diameters (33, 34).

An alternative method optionally includes the step of insulating the transducer 24 from temperature changes. This may mean disposing an enclosure around the transducer by placing the transducer within the borehole well casing 53 having a top opening, disposing the layer of insulating material 54 across the top opening of the casing, fluidly connecting the transducer 24 to the transducer tube 21 via the disconnectable connecting union 51 and an intermediate tube 52, and removably disposing the transducer 24 within the well casing 53 prior to disposing the layer of insulating material 54 across the open top.

Alternatively, insulating the transducer 24 may mean disposing an enclosure around the transducer by locating a thermally insulated housing 50 outside a borehole well casing 53, then locating the transducer 24 inside the housing 50, securing a disconnectable connecting union 51 at the top of the transducer tube 21, and placing the transducer in fluid communication with the transducer tube by extending a thermally insulated intermediate tube 52 between the connecting union and the transducer.

In another possible embodiment, the transducer tube 21 is placed within the interior of a slender casing 61 within the borehole 13, sealably attaching the disengageable connecting union 51 to the top of the transducer tube, and placing the transducer in fluid communication with the transducer tube by extending an intermediate tube 52 between the connecting union and the transducer. This alternative methodology permits a person practicing the inventive process to use an air-coupled transducer 24 located in a slender casing 61 such as the tube 17 for such systems not equipped with a separately situated transducer tube.

All versions of the method may have the step of situating a plurality of tubing systems into a common borehole.

The foregoing description of the system and method describes only the basic system. The actual use may be numerous duplications of the basic monitoring system, that is, a plurality of tube assemblies disposed in a single borehole. Other obvious embodiments such as pre-pressurizing the gas volume 23 in the transducer tube, the use of other gases, other thermal insulations, vented versus unvented transducers, and the like are within the scope of the present invention.

There accordingly have been disclosed an apparatus and method for monitoring water tables in multi-level ground water sampling systems. The method and apparatus are basic in concept, although somewhat more sophisticated in implementation, but with significant advantages. The inventor of the flexible liner multi-level sampling system described would have enjoyed the advantages for this design long ago if had he recognized the nonobvious utility of the present invention. The gas physics and the necessary mathematics particular to this invention obscured the feasibility of the design, slowing its innovation. Further, only relatively recent improvements in high-resolution pressure measurements have rendered practical the present invention for the broad range of borehole and water level conditions found in typical monitoring and measurement environments.

Laboratory tests of the present apparatus have revealed that numerous hypothetical perturbations are not important, and that the variations of partial pressure of the water vapor in the gas column 23 and temperature effects can be controlled to obtain calculations of better than one-inch resolution of water level changes in the subsurface environment. An additional advantage of the presently disclosed invention for the described multi-level system is that the transducer-derived water level change can be independently verified as often as desired by manually measuring the water level 5 in the pump tube 17. The manual level check is done after the pump tube 17 has been purged, and after the water level 5 has equilibrated at the current water level 6 in the geologic formation. Otherwise, the check valve 4 interferes with the manual verification check of the air-coupled system. The invention does not, however, interfere with the normal water sampling system, or manual water level measurement, as described herein with reference to FIG. 1.

Although the invention has been described in detail with particular reference to these preferred embodiments, other embodiments can achieve the same results. The present invention can be practiced by employing conventional materials, methodology and equipment. Accordingly, the details of such materials, equipment and methodology are not set forth herein in detail. In the previous description, specific details are set forth, such as specific materials, structures, chemicals, processes, etc., in order to provide a thorough understanding of the present invention. However, as one having ordinary skill in the art would recognize, the present invention can be practiced without resorting to the details specifically set forth. In other instances, well known processing structures have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover in the appended claims all such modifications and equivalents.

I claim:

1. An apparatus for monitoring changes in a level of a fluid in a formation, there being a borehole extending into the formation from a formation surface, the apparatus having at least one tubing system comprising:

a transducer tube extending in the borehole and having a top end above the formation surface and a bottom end below the fluid level in the formation;

a transducer above the formation surface and in closed fluid communication with the top end of the transducer tube, for measuring a gas pressure within an upper portion of the transducer tube; and a port tube in fluid communication with the fluid in the formation and with the bottom end of the transducer tube, via which port tube the fluid flows between the formation and a lower portion of the transducer tube, whereby a level of the fluid in the transducer tube tends to equilibrate with the level of the fluid in the formation;

wherein the level of fluid in the transducer tube affects the gas pressure within the upper portion of the transducer tube, and wherein further a change in gas pressure measured by the transducer indicates a change in the level of the fluid in the formation.

2. An apparatus according to claim 1, wherein the transducer tube comprises:

a dilated portion having a first diameter, extending from the level of the fluid in the formation up to a transition elevation; and a narrow portion, above the transition elevation, having a second diameter smaller than the first diameter of the dilated portion, the narrow portion extending up to, and connected to, the transducer;

wherein a change in a fluid level within the dilated portion of the transducer tube creates an amplified change in gas pressure within the narrow portion proportional to the difference between the first and second diameters.

3. An apparatus according to claim 1 further comprising an enclosure about the transducer tube, the enclosure comprising a slender casing around the transducer tube, wherein the transducer is in fluid communication with the transducer tube via a disengageable connecting union sealably attached to the top of the transducer tube and an intermediate tube extending between the transducer and the connecting union.

4. An apparatus according to claim 1, wherein the at least one tubing system comprises a plurality of tubing systems.

5. An apparatus according to claim 1 further comprising a flexible liner everted into the borehole to a depth below the level of the fluid in the formation, the liner substantially sealing the borehole walls against the flow of fluid between the formation and the borehole interior to the liner; wherein the transducer tube and the port tube are situated within the interior of the everted flexible liner.

6. An apparatus according to claim 5 wherein the tubing system further comprises:

a pump tube within the everted flexible liner and having a top end above the formation surface and a bottom end below the level of the fluid in the formation, the pump tube bottom end in fluid communication with the port tube;

a sample tube within the everted flexible liner and having a top end above the formation surface and a bottom end in fluid communication with the bottom end of the pump tube;

a port in the everted flexible liner at a sampling location elevation and in fluid communication with the port tube, wherein fluid in the formation flows into the pump tube via the port and port tube; and a check valve between the bottom end of the pump tube and the port tube for regulating fluid flow from the pump tube into the port tube;

wherein when a gas pressure is supplied to the top end of the pump tube, the check valve closes and a fluid sample within the pump tube is expelled above the formation surface via the sample tube.

7. An apparatus according to claim 1 further comprising an enclosure about the transducer for insulating the transducer from temperature changes.

8. An apparatus according to claim 7, wherein the enclosure comprises:

a borehole well casing having a top opening; and a layer of insulating material disposed across the top opening of the casing;

wherein the transducer is fluidly connected to the transducer tube via a disconnectable connecting union and an intermediate tube, whereby the transducer is removably disposable within the well casing prior to the disposition of the layer of insulating material.

9. An apparatus according to claim 7, wherein the enclosure comprises:

a thermally insulated housing located outside a borehole well casing;

a disconnectable connecting union at the top of the transducer tube; and a thermally insulated intermediate tube;

wherein the transducer is located within the housing and is in fluid communication with the transducer tube via the connecting union and intermediate tube.

10. A method for monitoring changes in a level of a fluid in a formation, there being a borehole extending into the formation from a formation surface, comprising the step of situating at least one tubing system in the borehole, wherein the step of situating at least one tubing system comprises:

extending a transducer tube in the borehole such that a top end of the transducer tube is above the formation surface and a bottom end of the transducer tube is below the fluid level in the formation;

disposing a transducer above the formation surface and in closed fluid communication with the top end of the transducer tube;

providing a port tube in fluid communication with the fluid in the formation and with the bottom end of the transducer tube;

allowing fluid to flow, via the port tube, between the formation and a lower portion of the transducer tube, whereby a level of the fluid in the transducer tube tends to equilibrate with the level of the fluid in the formation;

permitting any change in the level of fluid in the transducer tube, resulting from a change in the level of the fluid in the formation, to affect the gas pressure within an upper portion of the transducer tube, any change in gas pressure indicating a change in the level of the fluid in the formation; and measuring with the transducer a change in the gas pressure within the upper portion of the transducer tube.

11. The method of claim 10, wherein the step of extending a transducer tube comprises:

defining in the transducer tube a dilated portion, having a first diameter extending from the level of the fluid in the formation up to a transition elevation, and a narrow portion above the transition elevation, having a second diameter smaller than the first diameter of the dilated portion; and extending the narrow portion up to, and connecting the narrow portion to, the transducer;

wherein a change in a fluid level within the dilated portion of the transducer tube creates an amplified change in gas pressure within the narrow portion proportional to the difference between the first and second diameters.

12. The method of claim 10, wherein the step of extending the transducer tube comprises:

placing the transducer tube within the interior of a slender casing within the borehole; and further comprising the steps of:

sealably attaching a disengageable connecting union to the top of the transducer tube; and placing the transducer in fluid communication with the transducer tube by extending an intermediate tube between the connecting union and the transducer.

13. The method of claim 10, wherein the step of situating at least one tubing system comprises situating a plurality of tubing systems.

14. The method of claim 10 further comprising the steps of:

everting a flexible liner into the borehole to a depth below the level of the fluid in the formation to substantially seal, with the liner, the borehole walls against the flow of fluid between the formation and the borehole interior to the liner; and situating the transducer tube and the port tube within the interior of the everted flexible liner.

15. The method of claim 14 further comprising the steps of:

disposing a pump tube within the everted flexible liner such that a top end of the pump tube is above the formation surface and a bottom end of the pump tube is below the level of the fluid in the formation;

placing the pump tube bottom end in fluid communication with the port tube;

situating a sample tube within the everted flexible liner such that a top end of the sample tube is above the formation surface;

placing a bottom end of the sample tube in fluid communication with the bottom end of the pump tube;

providing at a sampling location elevation a port in the everted flexible liner in fluid communication with the port tube;

allowing fluid in the formation to flow into the pump tube via the port and port tube;

disposing a check valve between the bottom end of the pump tube and the port tube, and regulating with the check valve the fluid flow from the pump tube into the port tube; and supplying a gas pressure to the top end of the pump tube, thereby closing the check valve and expelling, via the sample tube and to above the formation surface, a fluid sample from within the pump tube.

16. The method of claim 10 further comprising the step of determining, from a measured change in the gas pressure within the upper portion of the transducer tube, a change in the level of fluid in the formation.

17. The method of claim 16, wherein the step of determining a change in the level of fluid in the formation comprises calculating the change in level of fluid using the formula $$\Delta WT = \frac{\Delta Pg}{c} + \frac{nRT\left(\frac{1}{Po} - \frac{1}{Pg}\right)}{A}$$

where ΔWT is the change in the formation fluid level, ΔPg is the measured change in the gas pressure in the upper portion of the transducer tube, c is a constant to convert from pressure to hydraulic head, n is the number of moles of gas in the upper portion of the transducer tube, R is the universal gas constant, T is the absolute temperature, Po is a first absolute pressure in the transducer tube, Pg is a subsequent second absolute pressure in the transducer tube, and A is a radial cross sectional area of the transducer tube.

18. The method of claim 10 further comprising the step of insulating the transducer from temperature changes.

19. The method of claim 18, wherein the step of insulating the transducer comprises disposing an enclosure around the transducer by:

placing the transducer within a borehole well casing having a top opening;

disposing a layer of insulating material across the top opening of the casing;

fluidly connecting the transducer to the transducer tube via a disconnectable connecting union and an intermediate tube; and removably disposing the transducer within the well casing prior to disposing the layer of insulating material.

20. The method of claim 18, wherein the step of insulating the transducer comprises disposing an enclosure around the transducer by:

locating a thermally insulated housing outside a borehole well casing;

locating the transducer inside the housing;

securing a disconnectable connecting union at the top of the transducer tube; and placing the transducer in fluid communication with the transducer tube by extending a thermally insulated intermediate tube between the connecting union and the transducer.

* * * * *